US007544873B1

(12) United States Patent
Stets

(10) Patent No.: US 7,544,873 B1
(45) Date of Patent: Jun. 9, 2009

(54) MODIFIED TREMOLO DEVICE FOR STRINGED MUSICAL INSTRUMENT

(75) Inventor: Eric Stets, West Seneca, NY (US)

(73) Assignee: Stets Machine Company, West Seneca, NY (US)

( * ) Notice: Subject to any disclaimer, the term of this patent is extended or adjusted under 35 U.S.C. 154(b) by 0 days.

(21) Appl. No.: 12/099,342

(22) Filed: Apr. 8, 2008

Related U.S. Application Data

(60) Provisional application No. 61/028,611, filed on Feb. 14, 2008.

(51) Int. Cl.
*G10D 3/00* (2006.01)

(52) U.S. Cl. ..... 84/313; 84/298

(58) Field of Classification Search ..... 84/313, 84/297 R, 298, 307, 312 R
See application file for complete search history.

(56) References Cited

U.S. PATENT DOCUMENTS 4,984,493 A * 1/1991 Schaller ..... 84/313
5,392,680 A * 2/1995 Stets ..... 84/313
6,989,483 B2 * 1/2006 Ramsay ..... 84/313
2003/0066407 A1 * 4/2003 Shimooka et al. ..... 84/313
2005/0150347 A1 * 7/2005 Hannes ..... 84/297 R

* cited by examiner

*Primary Examiner*—Jeffrey Donels
*Assistant Examiner*—Jianchun Qin
(74) *Attorney, Agent, or Firm*—Roach Brown McCarthy & Gruber P.C.; Kevin D. McCarthy

(57) ABSTRACT

A difference between the prior art and the present invention is that the applicant has added two stop screws. The two stop screws are positioned in a track adjuster and extend through the retainer's riser side so each stop screw contacts a corresponding terminal end of the brackets when a lever is (a) in the relaxed position or (b) moved up in relation to a musical instrument. That way stop screws can be adjusted to maintain a predetermined minimum distance between (a) a moving plate's second aperture or second perch and (b) the track adjuster's perches.

3 Claims, 6 Drawing Sheets

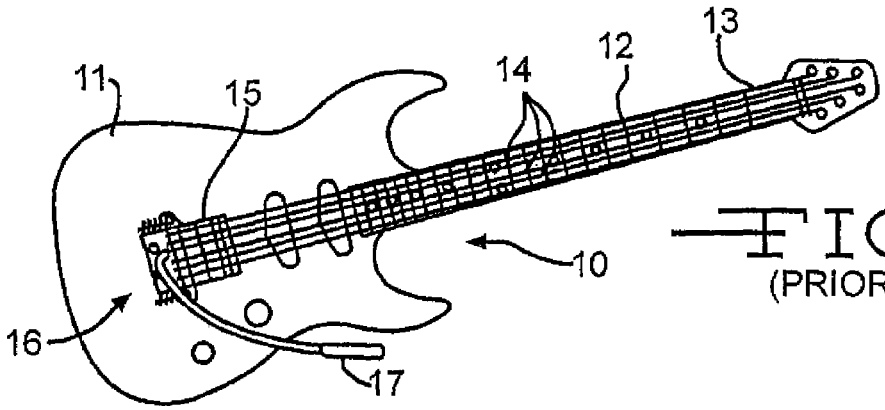
FIG. 1
(PRIOR ART)
FIG. 2
(PRIOR ART)
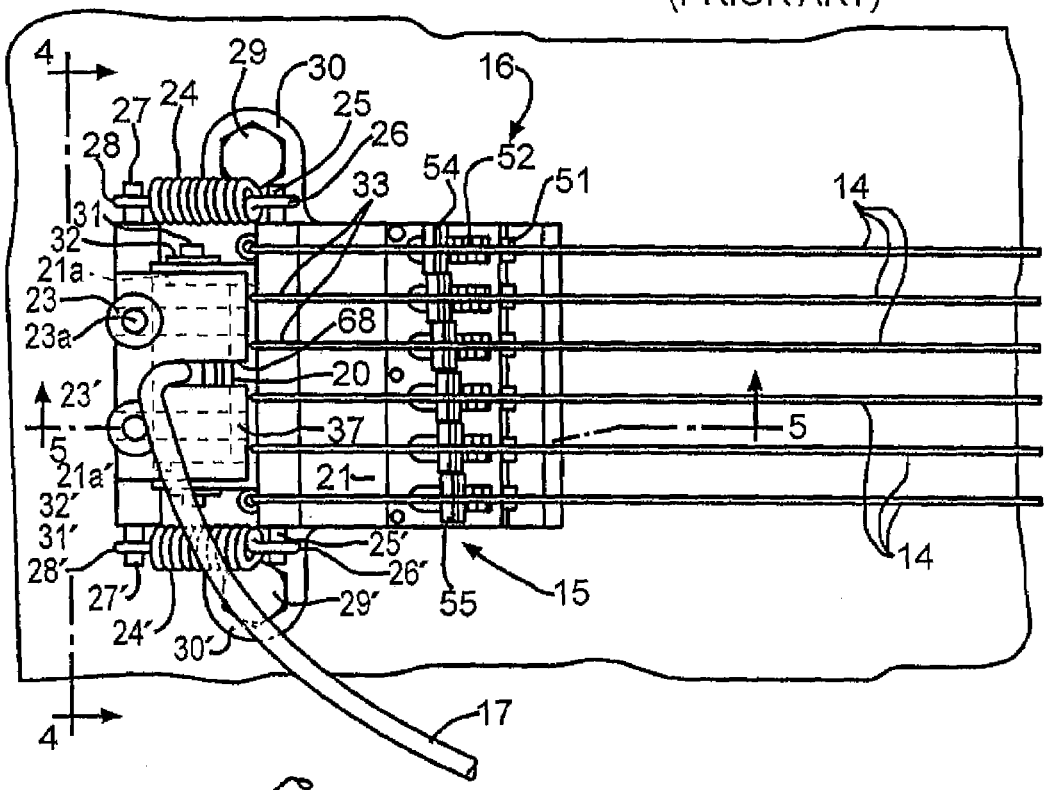
FIG. 3
(PRIOR ART)
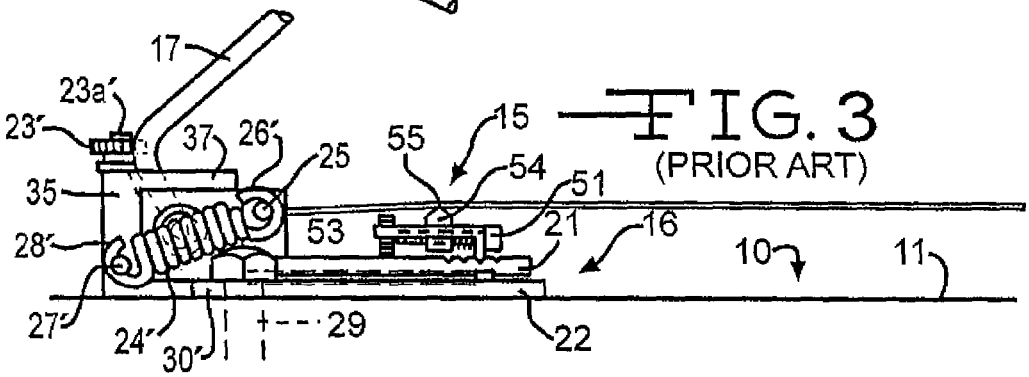

FIG. 4
(PRIOR ART)
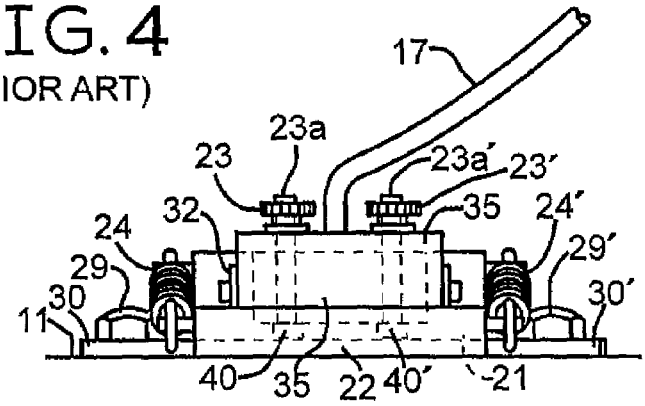
FIG. 5
(PRIOR ART)
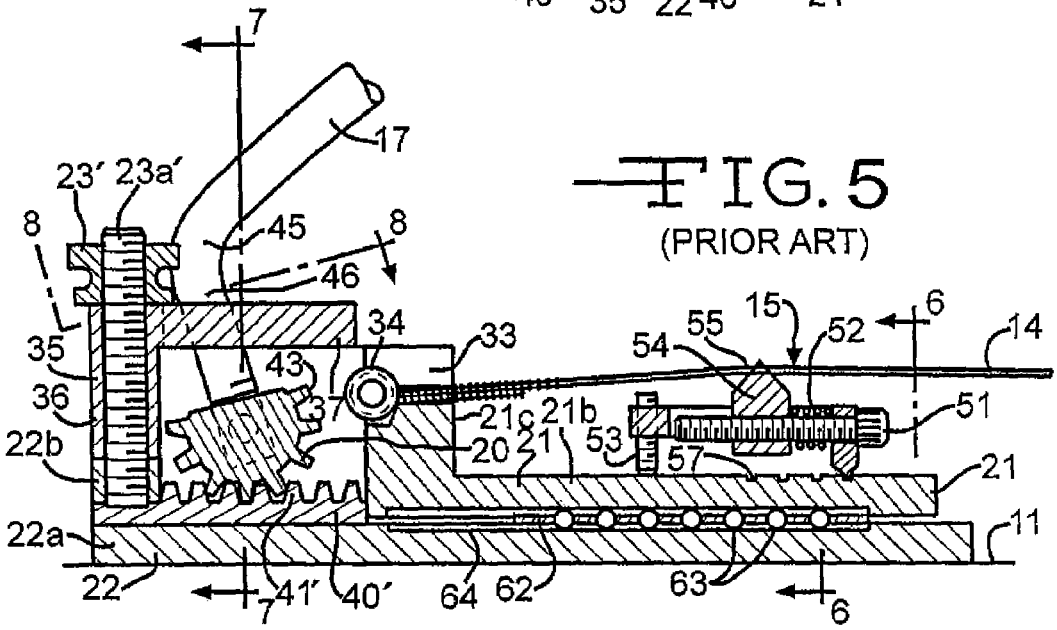
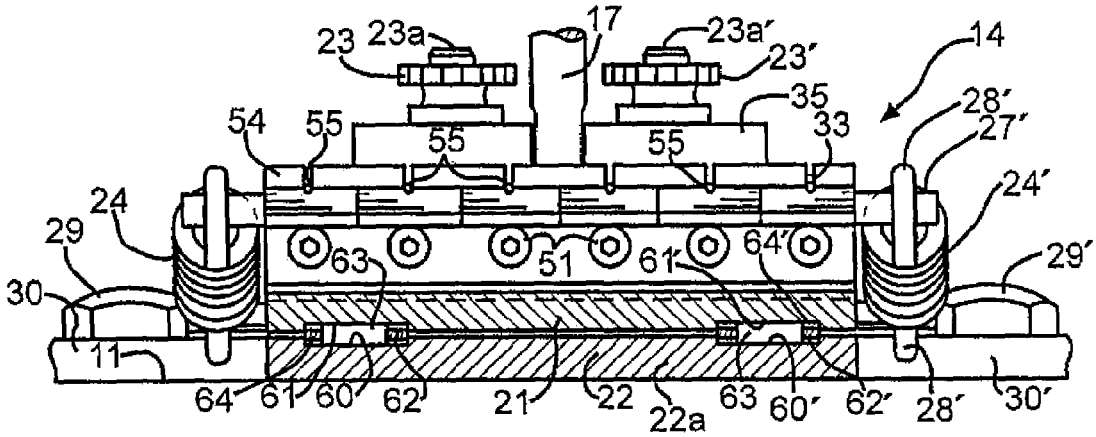
FIG. 6
(PRIOR ART)

MODIFIED TREMOLO DEVICE FOR STRINGED MUSICAL INSTRUMENT

CROSS REFERENCE TO RELATED APPLICATION

This application claims priority to U.S. provisional patent application Ser. No. 61/028,611, filed on Feb. 14, 2008.

BACKGROUND OF THE INVENTION

1. Field of the Invention

The invention relates to an improved tremolo device for use with a stringed instrument such as a guitar. The invention also relates to a stringed instrument having an improved tremolo device.

It is often desired to provide stringed instruments with a tremolo device that allows the instrument to produce its normal tones, but also to produce a tremulous tone effect, by suitable operation of the tremolo device. Existing stringed instruments can also be modified with the tremolo device of the invention. The tremulous tone effects result from changing the tension on the strings of the instrument. While these effects can be produced with other stringed musical instruments such as violins, base guitars, cellos and banjos, the description will be directed to guitars, which include acoustical and electric guitars.

In a conventional guitar, comprised of a body portion, a neck portion and a head portion, the strings attached at the head portion of the instrument, pass over the neck portion of the instrument and then pass over a bridge located in the body portion, and are then attached to the body of the guitar with a tailpiece. When certain tremolo devices known in the prior art are employed, sufficient friction can develop in the mechanisms of their tremolo devices that the tremolo devices may not always return to their original position, thereby resulting in poor sound quality emanating from the guitar.

2. Prior Art

The closest reference to the present invention is disclosed in U.S. Pat. No. 5,392,680 to Stets. Stets is also the inventor of this invention and as clearly alluded to in the title the present invention is a modification of the invention disclosed in U.S. Pat. No. 5,392,680. A difference between Stets' prior invention and this invention is that this invention maintains stability during any string tension change, which includes string breakage. However to appreciate the present invention, we will describe Stets' prior invention and prior modifications in greater detail.

U.S. Pat. No. 5,392,680

FIG. 1 shows a conventional musical instrument such as a guitar 10, which comprises a body portion 11, a head portion 12, a neck portion 13, a multiplicity of strings 14 and a bridge member 15. A tremolo device 16 of the invention is shown attached to the body portion 11 of the guitar 10. Lever 17 of the invention is shown as part of tremolo device 16.

A fragmentary portion of the body portion 11 of guitar 10 is shown in FIG. 2. The tremolo device 16 of the invention is shown attached to body portion 11 by means of metal bolts 29 and 29' that pass through metal lugs 30 and 30' and into body portion 11. Pinion gear 20 is joined to bracket 21*a* of movable plate 21 by means of metal spindles 31 and 31' that are attached to movable plate 21 and seated in bearings 32 and 32'. In addition to bracket 21*a*, movable plate 21 has a horizontal portion or component 21*b* and a vertical portion or component 21*c*. Lever 17 is shown attached to pinion gear 20. Metal thumb nuts 23 and 23' together with metal screws 23*a* and 23*a*', respectively, serve to attach metal lock cover 35 to fixed plate 22. Metal spring 24 is attached to movable plate 21 and fixed plate 22 by means of hooks 26 and 28, respectively, that are attached to perches 25 and 27, respectively. The metal spring 24' is attached to movable metal plate 21 and fixed metal plate 22 by means of hooks 26' and 28' respectively, that are attached to perches 25' and 27', respectively. The metal springs 24 and 24' serve to apply tension to counter the tension being exerted by strings 14, to hold movable plate 21 and fixed plate 22 in relative position with respect to each other.

FIG. 2 further shows six strings 14 positioned in essentially parallel direction. The strings extend from the head portion 12 of the guitar 20 as shown in FIG. 1. The strings pass over the saddle notches 55 of the saddle members 54 of bridge member 15. The strings 14 pass through string mounting holes 33 in the vertical portion 21*c* of movable block 21 and terminate in a suitable terminal end such as terminal rings 34.

FIG. 3 is a side elevation of FIG. 2 which shows a cutaway view of the body portion 11 of guitar 10. Fixed plate 22 is attached to body portion 11 by means of bolt 29' which passes through metal lug 30' into body portion 11. Relative positions of fixed plate 22 and movable plate 21 are maintained by the tension applied by strings 14 and the counter tension applied by metal spring 24'. Metal spring 24' is attached to movable plate 21 and fixed plate 22 by means of hooks 26' and 28', respectively, that are attached to perches 25' and 27', respectively. String 14 passes over saddle notches 55 of saddle members 54 of bridge 15 and toward movable plate 21. Lever 17 is attached to pinion gear 20. Metal lock cover 35 is attached to fixed plate 22 by metal thumb nut 23 and metal screw 23*a* as shown in FIG. 5.

FIG. 4 is an end elevation of FIG. 3 generally along line 4-4 in FIG. 2. Fixed plate 22 is attached to body portion 11 by means of metal bolts 29 and 29' which pass through metal lugs 30 and 30', respectively, and into body portion 11. Pinion gear 20 is joined to bracket 21*a* of movable plate 21 by means of metal spindles 31 and 311 that are seated in bearings 32 and 32', respectively. Metal spring 24 is attached to movable plate 21 and fixed plate 22 by means of hooks 26 and 28, respectively, that are attached to metal perches 25 and 27, respectively, as shown in FIG. 2. Metal spring 24' is attached to movable plate 21 and fixed plate 22 by means of hooks 26' and 28', respectively, that are attached to perches 25' and 27', respectively, as shown in FIG. 2. Metal thumb nuts 23 and 23' pass through horizontal portion 37 and vertical portion 36 of metal lock cover 35 and attach the metal lock cover 35 to fixed plate 22 as shown in FIG. 5. Fixed plate 22 can comprise horizontal component 22*a* and vertical component 22*b* which can be made in one piece or can be individually produced and fastened together. Gear racks 40 and 40' protrude from fixed plate 22 as shown in FIG. 5. Lever 17 is attached to pinion gear 20.

In FIG. 5, fixed plate 22 is attached to the body portion 11 of the guitar 10. A gear rack 40 is attached to the upper surface of the horizontal component 22*a* of fixed plate 22. A pinion gear 20 is linked to movable plate 21 by means of metal spindles 31 and 31' at the ends of pinion gear 20, which are fastened in bearings 32 and 32', which are mounted in brackets 21*a* on the movable plate 21 as shown in FIG. 2. A lever 17 is attached to the pinion gear 20. Strings 14 pass over the saddle notches 55 of bridge 15, then through string mounting holes 33 in movable plate 21, terminating in a terminal end such as a ring 34. All the components of movable plate 21, that is bracket 21*a*, horizontal component 21*b* and vertical component 21*c* can be cast in one piece or can be individually produced and fastened together.

FIG. 5 further shows the details of the gear rack 40 which is provided with teeth 41. Pinion gear 20 is provided with teeth 43 around the circumference thereof. Lever 17 is preferably provided with a bend 45, and optionally with flat surfaces 46 which can be machined into the surfaces of the lever 17 near where it adjoins with the pinion gear 20. When desired, the lever 17 can be twisted or rotated so that the machined surfaces 46 of the lever 17 can be tightened up in the confines of the slot 48 in the upper portion of the horizontal portion 37 of the metal cover 35, as shown in FIG. 8.

Each string 14 is provided with a bridge member 15. In FIG. 5, the bridge 15 is provided with saddle notch 55 of saddle 54. String 14 rests in the saddle notch 55. The saddle adjustment screws 51 adjust the saddle 54 longitudinally to lengthen or shorten the pitch length of the string 14. Saddle tension spring 52 prevents the saddle 54 from floating or moving on its own. The saddle tension spring 52 provides sufficient tension to retain the adjusted position. The bridge height adjustment screw 53 adjusts the height of the bridge 15. The bridge reference point 56 is situated in the bridge reference groove 57 and is used when needed to find another point of adjustment beyond that normally provided.

Furthermore in FIG. 5, anti-friction bearings such as needle bearings 63 are contained in the cavity created by slots 60 and 61 that have been cut in the opposing faces of fixed plate 22 and movable plate 21, respectively. Bearing cage 62 maintains the bearings 63 in relative position.

In the operation of the tremolo device of the invention, tension in string 14 is decreased by depressing lever 17 which causes pinion gear 20 to rotate, thereby driving the movable plate 21 to cause the tremolo effect when the musical instrument 10 is played. Tension on string 14 is increased by releasing lever 17, and the sound of the instrument returns to is original tone.

FIG. 6 is a vertical section taken along line 6-6 of FIG. 5. Fixed plate 22 is shown attached to body portion 11 by means of metal bolts 29 and 29' which pass through lugs 30 and 31', respectively, into body portion 11. The tension applied by strings 14 and the opposing or counter tension applied by metal springs 24 and 241 serve to maintain the relative position of fixed plate 22 and movable plate 21. Perches 27 and 27' protrude from movable plate 21. Hooks 28 and 28' engage the perches 27 and 27', respectively, as shown in greater detail in FIGS. 2 and 3. Metal thumb nuts 23 and 23' attach metal lock cover 35 as shown in FIG. 3 and FIG. 5. String mounting holes 33 permit the passage of strings 14 into and through the movable plate 21. Slots 60 and 60' are machined in the upper face of fixed plate 22. Slots 61 and 61' are machined in the lower face of movable plate 21. These slots form cavities 64 and 64' for insertion of anti friction bearings, such as needle bearings 63 and 63'. Bearing cages 62 and 62' made of plastic material maintain the bearings 63 and 63' in their proper relative positions within cavities 64 and 64'.

FIG. 7 is a reduced vertical section taken along line 7-7 in FIG. 5. Fixed plate 22 is attached to body portion 11 by metal bolts 29 and 29' which pass through metal lugs 30 and 30', respectively into body portion 11, as shown in FIG. 6. The horizontal component 22*a* and the vertical component 22*b* are show in FIG. 7. Fixed gear racks 40 and 40' are attached to the horizontal component 22*a* of fixed plate 22. Pinion gear 20 is attached to movable plate 21 at brackets 21*a* and 21*a'* by means of metal spindles 31 and 31' seated in bearings 32 and 32', respectively. Metal thumb nuts 23 and 231 are used to attach metal lock cover 35 to the fixed plate 22 with the aid of metal screws 23*a* as shown in FIG. 5. Metal springs 24 and 24' are used to hold movable plate 21 in relative position to fixed plate 22 by virtue of the tension applied by strings 14 which balances the counter tension applied by the metal springs 24 and 24'. Lever 17 is attached to pinion gear 20.

FIG. 8 is a greatly enlarged fragmentary section taken along line 8-8 of FIG. 5. Horizontal portion 37 of metal lock cover 3S has a slot 68 into which is inserted lever 17 at its machined surface 48. The structure allows for lever 17 to lock when rotated in fixed a position when the tremolo effect is not desired. When a tremolo effect is desired lever 17 is rotated out from the locked position.

The tremolo device of the invention is suitable for use in various stringed instruments, such as acoustic and electric guitars, base guitars, violins, cellos an banjos. The strings for such instruments are generally six in number, but there can be as many as 12 strings. Base guitars generally have 4, 5, or 6 strings. The strings for such instruments can be made of nickel alloys, stainless steels, brass and plastics such as nylon. The body of stringed instruments is generally made of wood. Some stringed instruments have some metal parts.

The tremolo device of the invention can be made of various metals. The fixed and movable plates are generally made of low carbon steel or bronze. The gear rack and pinion gear are generally made of brass or low carbon steel.

The bearings are preferably needle bearings, but other bearings, such as roller or ball bearings can be employed.

The bearing cage materials can be made of plastics, such as nylon or polyoxymethylenes (Delrin).

Modifications to Stets Design

Around the year 2000, Stets modified the rack and pinion system identified in U.S. Pat. No. 5,392,680. The rack and pinion system of the prior art was replaced with a conventional swing link mechanism 800 to render the product easier to manufacture. FIGS. 9 and 10 illustrate the swing link mechanism 800 modification.

In the swing link mechanism modification, the fixed plate 22 was divided into two components—(1) a mounting fix plate 722 which is designed to be positioned against the original component of the string instrument, and (2) a retainer 724 having a U shape configuration having an exterior surface 725 and an interior surface 726. On the exterior surface 725, U shape configured retainer 724 has a bottom side 727 that connects to the mounting fix plate 722, a riser side 728 that faces the movable plate 21, a top side 730, a right edge 732 and a left edge 734.

In the interior surface 726 is a track adjuster 740. The track adjuster 740 has the perches 27 and 27' that extend beyond the retainer's right and left edges 732, 734. The biasing members' 24, 24' hooks 28, 28' respectively connect to the perches 27, 27'. The track adjuster 740 also has two apertures that receive tension adjusting screws 23, 23'. The tension adjusting screws 23, 23' are designed to contact (see phantom lines) the interior surface 726 of the riser side 728 to adjust the distance of the track adjuster from the moving plate 21, which in turn adjusts the tension of the biasing members 24, 24'. Once the tension adjusting screws 23, 23' are set, the track adjuster 740, the mounting fix plate 722 and the retainer 724 do not move (except when the tension adjusting screws are adjusted), even when the lever 17 is moved.

The moving plate 21 also has a first bracket 700 and a second bracket 700' that extend from the moving plate's vertical portion 21*c* toward the retainer 724 (or away from the bridge 15). In particular the first and second brackets 700, 700' (a) have a first aperture 702, 702', (b) have a second aperture or a second perch 704, 704' that secure the biasing members' 24, 24' hooks 26, 26' to the moveable plate 21, and (c) align with the retainer's right and left edges 732, 734.

The lever 17 interconnects to a conventional swing link 800, in particular a top side 801 of the swing link 800. The swing link 800 has the top side 801, a length (l) that fits between the two brackets 700, 700', a first aperture 803, 803' at each bracket end that corresponds to a respective bracket's first aperture 702, 702', a rounded bottom side 802, 802', a second aperture 808, 808' that is positioned within the radius of the rounded bottom sides 802, 802', and a gap area (not shown) between the two rounded sides 802, 802'. The rounded bottom side 802 contacts the mounting fix plate 722 while the gap area fits over a locator plate 850. The locator plate 850 is affixed to the mounting fix plate 722 and is positioned in between the exterior riser side 728 and the moving plate 21. The locator plate 850 has an aperture 852, 852' that corresponds with the second aperture 808, 808' to allow a pin (not shown) connect the locator plate 850 to the swing link 800 so that when the lever 17 is moved up or down in relation to the musical instrument the movable plate 21 moves forward or backward the desired distance.

In this embodiment, (1) when the lever 17 is moved down (toward the musical instrument), the biasing members 24, 24' increase in tension and the moving plate 21 moves away from the retainer 724; (2) when the lever 17 is in the relaxed state (not being moved) the biasing members 24, 24' continue to provide tension but not as much as when the lever 17 is moving down and the moving plate remains in place; and (3) when the lever 17 is moved up, (a) the biasing members 24, 24' decrease in tension, (b) the retainer 724 and the track adjuster 740 do not move, and (c) the moving plate 21 moves toward the retainer 724. These facts are important in distinguishing the prior art from the claimed invention because the present invention maintains stability during any string tension change, which includes string breakage, and the prior art does not because of that movement.

SUMMARY OF THE INVENTION

A difference between the prior art and the present invention is that the applicant has added two stop screws. The two stop screws are positioned in a track adjuster and extend through the retainer's riser side so each stop screw contacts a corresponding terminal end of the brackets when a lever is (a) in the relaxed position or (b) moved up in relation to a musical instrument. That way stop screws can be adjusted to maintain a predetermined minimum distance between (a) a moving plate's second aperture or second perch and (b) the track adjuster's perches.

BRIEF DESCRIPTION OF THE DRAWINGS

FIG. 1 is prior art of an elevational view of a musical instrument on which the invention may be used.

FIG. 2 is prior art and an enlarged fragmentary portion of the body portion of the instrument in the left end of FIG. 1.

FIG. 3 is prior art and a side elevation of FIG. 2.

FIG. 4 is prior art and an end elevation of FIG. 3 generally along line 4-4 in FIG. 2.

FIG. 5 is prior art and an enlarged vertical section taken along line 5-5 in FIG. 2.

FIG. 6 is prior art and a vertical section taken along line 6-6 of FIG. 5.

DETAILED DESCRIPTION OF THE INVENTION

Figure 7:
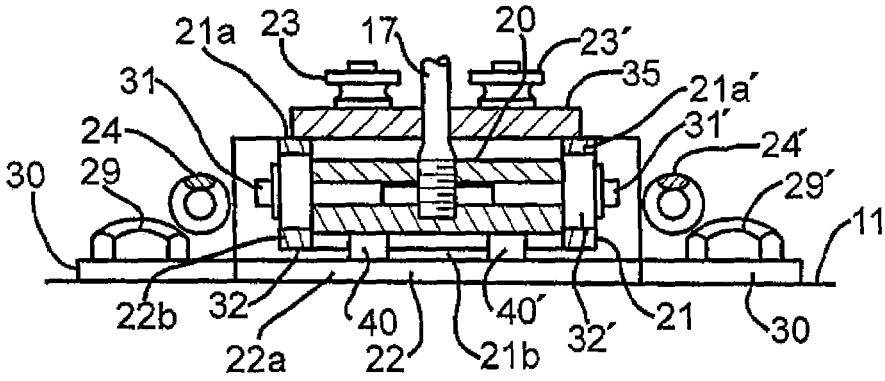
FIG. 7 (PRIOR ART)
FIG. 7 is prior art and a reduced vertical section taken along 7-7 in FIG. 5.
Figure 8:
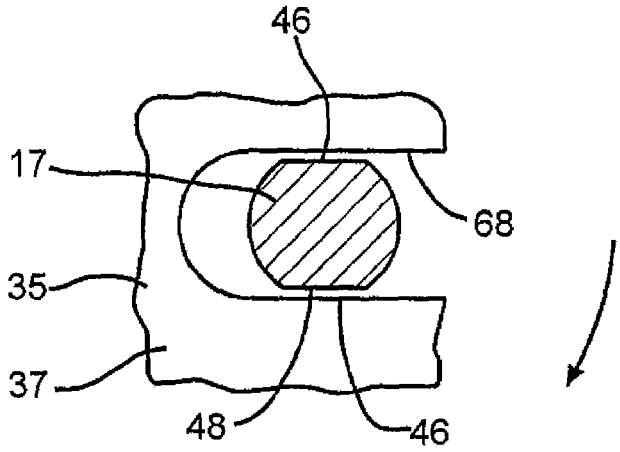
FIG. 8 (PRIOR ART)
FIG. 8 is prior art and a greatly enlarged fragmentary section taken along line 8-8 of FIG. 5.
Figure 9:
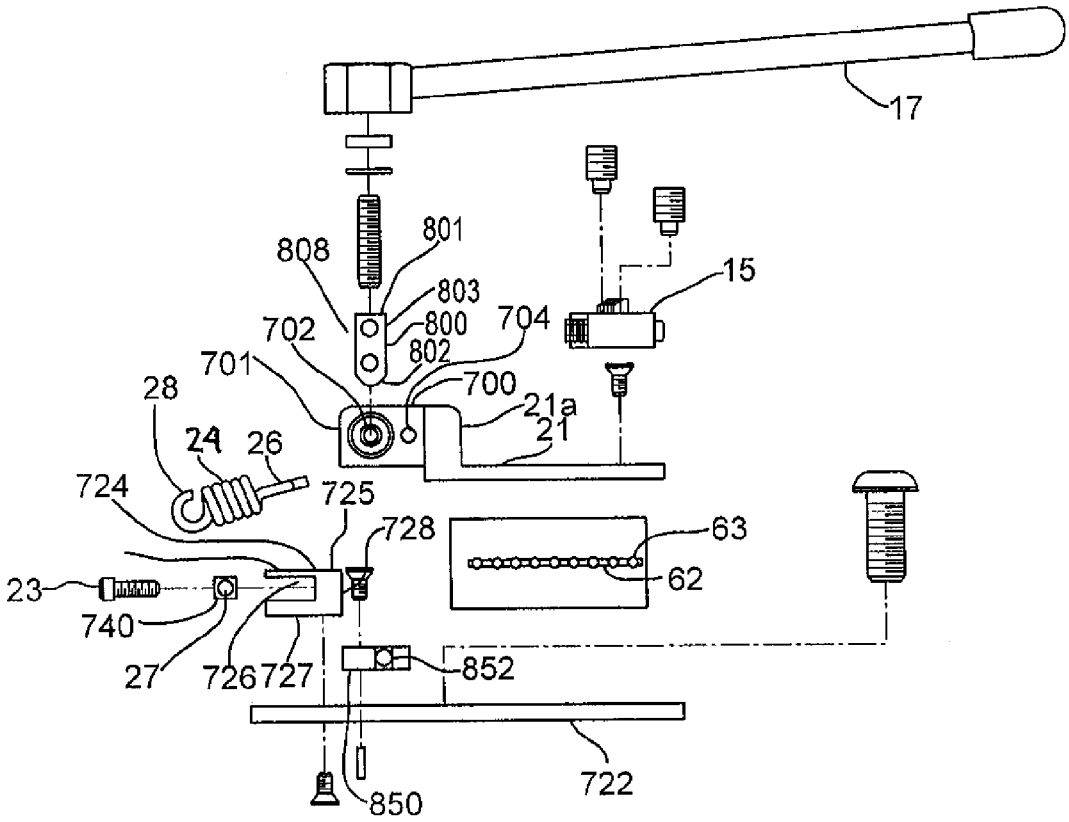
FIG. 9 (PRIOR ART)
FIG. 9 is prior art, a modification of FIGS. 1-8 and is an exploded view thereof.
Figure 10:
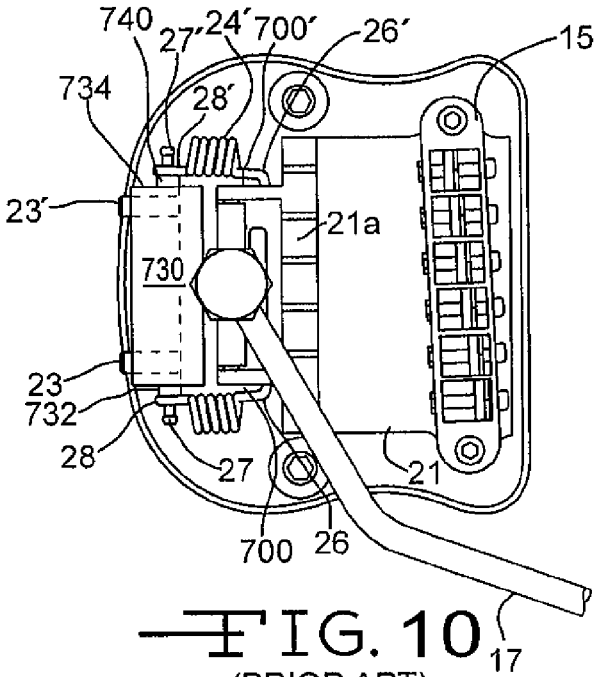
FIG. 10 (PRIOR ART)
FIG. 10 is a top view of FIG. 9 put together.
Figure 11:
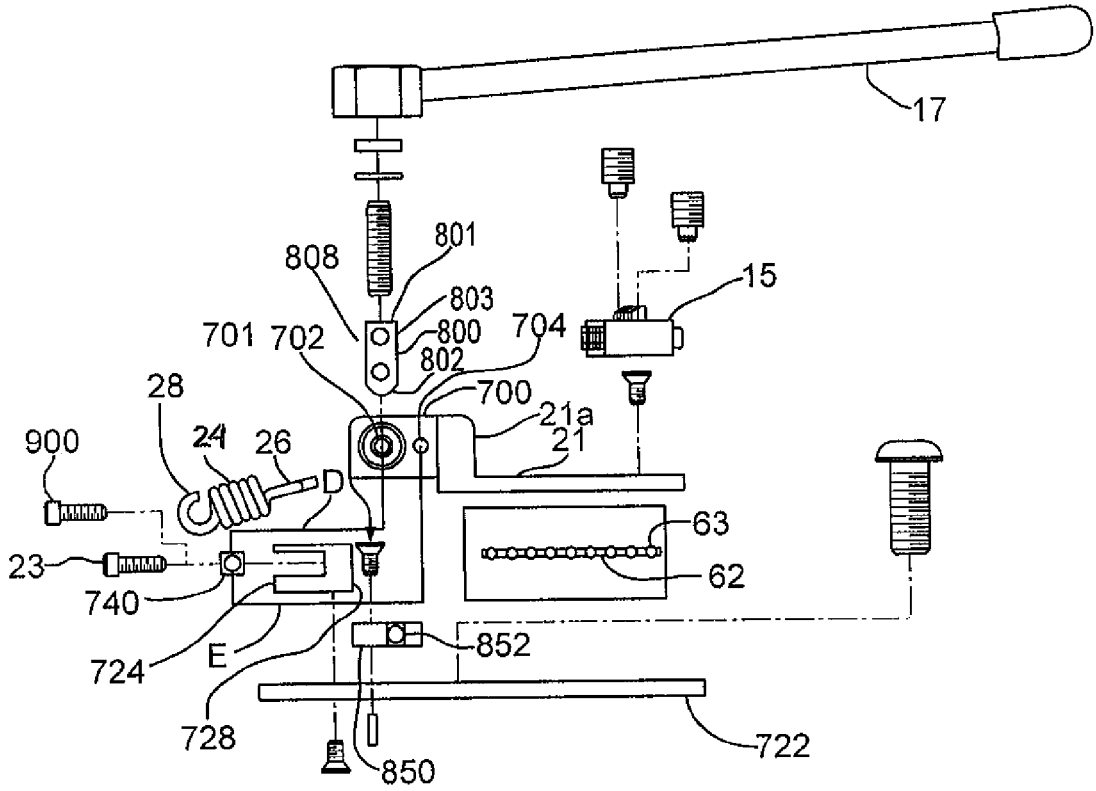
FIG. 11 (PRIOR ART)
FIG. 11 is an exploded view of the present invention.
Figure 12:
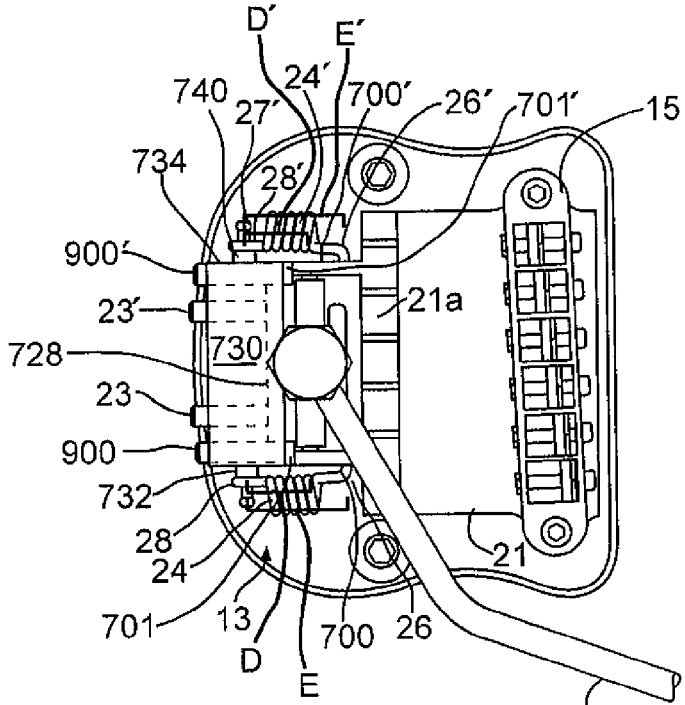
FIG. 12 (PRIOR ART)
FIG. 12 is a top view of FIG. 10 put together.
Figure 13:
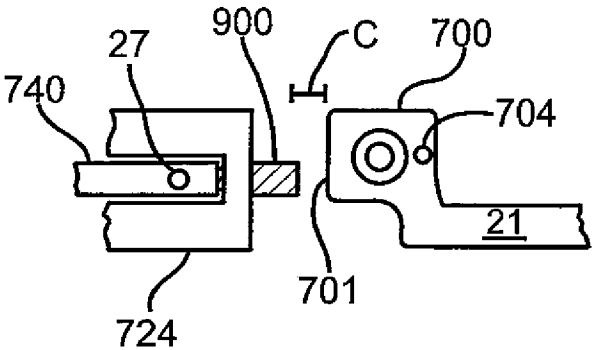
FIG. 13 illustrates a close up view of FIG. 12 taken along the view of arrow 13 when the lever is pushed down toward the musical instrument and without illustrating the biasing member.

The current invention, as illustrated in FIGS. 11 and 12, is a further modification of the section entitled "Modifications to Stets Design." A significant difference between the prior art and the present invention is that the applicant has added two stop screws 900, 900'. The two stop screws 900, 900' are positioned in the track adjuster 740 and extend through the retainer's riser side 728 so each stop screw 900, 900' contacts a corresponding terminal end 701, 701' of the brackets 700, 700' when the lever 17 is in the relaxed position or moved up in relation to the musical instrument. That way stop screws can be adjusted to maintain a predetermined minimum distance between (a) the second aperture or a second perch 704, 704' (and inherently the moving plate) and (b) the perches 27 and 27'. This embodiment has the following results:

A) When the lever 17 is moved down (toward the musical instrument), the biasing members 24, 24' increase in tension and the moving plate 21 moves away from the retainer 724 as illustrated in FIG. 13—notice the distance C between the stop screw 900 and the terminal end 701. That distance C illustrates the increased tension on the biasing member (not shown in FIG. 13) that connects first perch 27 positioned on the track adjuster 740 to a second perch 704 positioned the bracket 700.

Figure 14A:
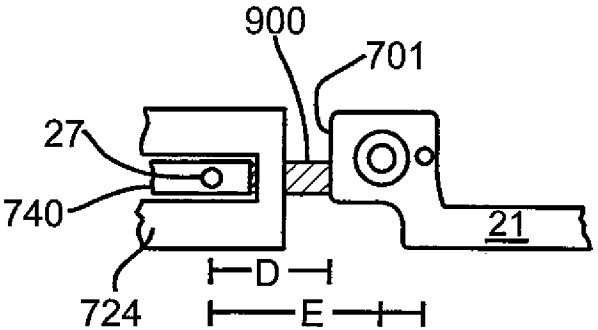
FIGS. 14*a* and 14*b* illustrate FIG. 13 when the lever is (a) in a relaxed state (FIG. 14*a*) and (b) pushed up toward the musical instrument.

B) When the lever 17 is in the relaxed state (not being moved) (FIG. 14*a*) or moved up (away from the musical instrument) (FIG. 14*b*), the biasing members 24, 24' tension as applied to the moving plate 21 is not altered (notice there is no distance C between the stop screw 900 and the terminal end 701 as illustrated in FIG. 13).

Figure 14B:
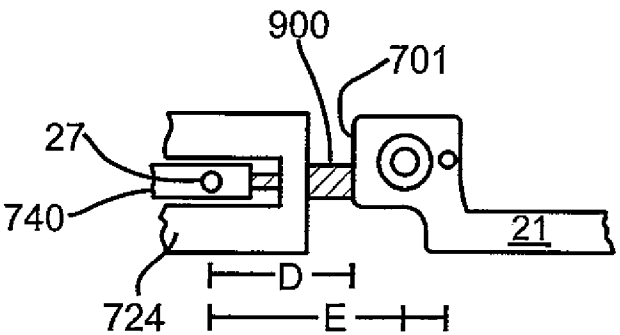

C) When the lever 17 is moved up (the terminal end 701 is exaggerated to illustrate the lever is moving up in FIG. 14*b*) the moving plate 21 moves toward the retainer 724, which does not move. The terminal end 701 pushes on the stop screw 900. In response, the stop screw moves the track adjuster 740 within the interior surface of the retainer 724 to retain the predetermined minimum distance between (a) the perches 27 and 27' and (b) the terminal end 701, 701' of the brackets 700, 700' (D, D') and the second aperture or a second perch 704, 704' (E, E') (a.k.a., pre-load distance) that is found when the lever is in the relaxed state.

This embodiment provides that the pitch of the musical instrument is maintained because the movable plate 21 would not be allowed to move beyond the pre-load distance when the lever is being moved up. By controlling the pitch of the strings, even when one of the strings is broken, is a desired result. This embodiment obtains the desired result which was not fully obtainable with the prior art.

The stop screws 900, 900' can be any other object that can be adjusted within the track adjuster 740 and extend through the retainer's riser side 728 to maintain the predetermined minimum distance between (a) the second aperture or a second perch 704, 704' (and inherently the moving plate) and (b) the perches 27 and 27'. Examples of such objects include and are not limited to threaded pegs with clips thereon or extending therefrom, unthreaded pegs with clips thereon or extending therefrom and equivalents thereof.

The biasing members 24, 24' can be any conventional springs, nitonol material or any other conventional biasing structure. Preferably the biasing members 24, 24' are springs simply because they are easy to use and replace.

While the present invention has been described and illustrated in conjunction with a number of specific embodiments, those skilled in the art will appreciate that variations and modifications may be made without departing from the principles of the invention as herein illustrated, described and claimed. The present invention may be embodied in other specific forms without departing from its spirit or essential characteristics. The described embodiments are to be considered in all respects as only illustrative, and not restrictive. The scope of the invention is, therefore, indicated by the appended claims, rather than by the foregoing description. All changes which come within the meaning and range of equivalency of the claims are to be embraced within their scope.

I claim:

1. A stringed musical instrument comprising a head portion, a neck portion, a body portion, a plurality of generally parallel strings attached to the head portion and to the body portion, and a bridge member which engages the strings in a position adjacent to the body portion, the improvement comprising a mounting fix plate attached to the body portion;

a movable plate (a) having the bridge member, (b) having a vertical portion positioned further from the head portion than the bridge member, (c) that is slideable with respect to the mounting fix plate, and (d) a first bracket extending from the vertical portion away from the bridge member and having a first hook receiving device to receive a first hook from a biasing device;

a retainer (a) positioned a predetermined distance from the first bracket (b) having a U shape configuration having an exterior surface and an interior surface, and (c) the exterior surface of the U shape configured retainer has a bottom side that connects to the mounting fix plate, a riser side that faces the movable plate, a top side, a right edge and a left edge;

a track adjuster (a) is positioned in the interior surface, (b) has a second hook receiving device that receives a second hook from the biasing device, (c) has at least one tension screw that contacts the interior surface of the riser side to maintain and/or adjust the distance of the track adjuster from the moving plate to adjust or maintain the desired force of the biasing device, and (d) has at least one stopper screw that contacts the first bracket to adjust or maintain the predetermined minimum distance between the first hook receiving device and the second hook receiving device;

a lever interconnected to a swing link, the swing link is interconnected to the brackets and has a portion contact the mounting fix plate, so (a) when the lever is moved down toward the musical instrument, the biasing devices increase in tension and the moving plate moves away from the retainer; and (b) when the lever is in the relaxed state or moved up away from the musical instrument, the biasing device's tension is not altered but when the lever is moved up the moving plate moves toward the retainer and the track adjuster moves within the interior surface of the retainer to retain the predetermined minimum distance between the first hook receiving device and the second hook receiving device.

2. The stringed musical instrument of claim 1 further comprising a locator plate affixed to the mounting fix plate.

3. A stringed musical instrument comprising a first string and a second string that are generally parallel to each other;

a bridge member which engages the first string and the second string;

a mounting fix plate attached to stringed musical instrument;

a movable plate (a) having the bridge member, (b) having a vertical portion, (c) that is slideable with respect to the mounting fix plate, and (d) a first bracket extending from the vertical portion away from the bridge member and having a first hook receiving device to receive a first hook from a first biasing device;

a retainer (a) positioned a predetermined distance from the first bracket, (b) having a U shape configuration having an exterior surface and an interior surface, and (c) the exterior surface of the U shape configured retainer has a bottom side that connects to the mounting fix plate, a riser side that faces the movable plate, a top side, a right edge and a left edge;

a track adjuster (a) is positioned in the interior surface, (b) has a second hook receiving device that receives a second hook from the first biasing device, (c) has at least one tension device that contacts the interior surface of the riser side to maintain and/or adjust the distance of the track adjuster from the moving plate to adjust or maintain the desired force of the biasing device, and (d) has at least one stopper device that contacts the first bracket to adjust or maintain a predetermined minimum distance between the first hook receiving device and the second hook receiving device;

a lever interconnected to a swing link, the swing link is interconnected to the brackets and has a portion contact the mounting fix plate, so (a) when the lever is moved down toward the musical instrument, the biasing devices increase in tension and the moving plate moves away from the retainer; and (b) when the lever is in the relaxed state or moved up away from the musical instrument, the biasing device's tension is not altered but when the lever is moved up the moving plate moves toward the retainer, which does not move, and the track adjuster moves within the interior surface of the retainer to retain the predetermined minimum distance between the first hook receiving device and the second hook receiving device.

* * * * *